US006826891B2

(12) United States Patent
Sauer

(10) Patent No.: US 6,826,891 B2
(45) Date of Patent: Dec. 7, 2004

(54) DEVICES AND METHOD FOR BUNDLING A STACK OF SHEET-TYPE OBJECTS

(75) Inventor: Hartmut Karl Sauer, Himmelstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/451,155

(22) PCT Filed: Feb. 7, 2002

(86) PCT No.: PCT/DE02/00439

§ 371 (c)(1),
(2), (4) Date: Jun. 30, 2003

(87) PCT Pub. No.: WO02/074629

PCT Pub. Date: Sep. 26, 2002

(65) Prior Publication Data

US 2004/0065050 A1 Apr. 8, 2004

(30) Foreign Application Priority Data

Mar. 20, 2001 (DE) ..... 101 13 339

(51) Int. Cl.[7] ..... B65B 11/16

(52) U.S. Cl. ..... 53/399; 53/228; 53/586; 53/589; 53/466; 100/3; 100/7; 100/17

(58) Field of Search ..... 53/228–233, 218, 53/399, 436, 447, 466, 528, 529, 540, 544, 586–591, 375.9, 439; 100/3, 7, 17

(56) References Cited

U.S. PATENT DOCUMENTS 3,690,090 A * 9/1972 van de Bilt et al. ..... 53/589
4,276,736 A 7/1981 Haberstroh et al.
4,617,784 A * 10/1986 Golicz et al. ..... 53/540
4,627,218 A 12/1986 Akerstrom et al.
4,910,944 A * 3/1990 Segalowitz et al. ..... 53/586
4,930,293 A * 6/1990 Hanscom ..... 53/590
5,001,974 A * 3/1991 Gombos ..... 100/4
5,353,576 A 10/1994 Palamides et al.
6,085,487 A * 7/2000 De Vlaam ..... 53/176
6,318,053 B1 * 11/2001 Frank et al. ..... 53/586
6,550,221 B1 * 4/2003 Neri ..... 53/399

FOREIGN PATENT DOCUMENTS

| | | |
|---|---|---|
| DE | 1 221 134 | 7/1966 |
| DE | 2 155 367 | 5/1973 |
| DE | 37 42 787 C2 | 5/1990 |
| EP | 0 640 529 A1 | 3/1995 |

* cited by examiner

*Primary Examiner*—Stephen F. Gerrity
*Assistant Examiner*—Hemant M. Desai
(74) *Attorney, Agent, or Firm*—Jones Tullar & Cooper, PC

(57) ABSTRACT

A stack of sheet-type objects are bundled while supported on a support plate. A banding strip is guided in a channel formed in the plate. The support plate can be pushed through a shaft that is formed by a pair of spaced sidewalls. A tongue is displaceable between an extended position, in which it separates the channel from the surface of the supporting plate, and a withdrawn position in which the channel is placed in an open position with respect to the surface of the supporting plate. A spring is used to hold the banding strip in contact with an underside of the stack of sheet-type objects.

24 Claims, 6 Drawing Sheets

DEVICES AND METHOD FOR BUNDLING A STACK OF SHEET-TYPE OBJECTS

FIELD OF THE INVENTION

The present invention is directed to devices and to a method for bundling a stack of sheet-like objects, in particular bank notes. The stack of objects to be banded is placed on a support plate. A banding strip crosses between the surface of the support plate and an underside of the stack.

BACKGROUND OF THE INVENTION

In a prior device, a stack is created with the aid of a paddle wheel, whose paddles unload the objects to be stacked singly on the feed plate or the stack. Such a device is particularly suitable for use in connection with a money counting machine, and specifically for the automatic counting and wrapping of used bank notes.

SUMMARY OF THE INVENTION

The object of the present invention is directed to providing devices and a method for bundling a stack of sheet-like, objects, in particular bank notes.

In accordance with the present invention, this object is attained by placing the stack of objects on a support plate that is provided with a channel. A banding strip is pushed through the channel beneath the stack of objects. The support plate can be pushed into a chute formed between lateral walls. This folds the banding strip over against the lateral faces of the walls and against the side faces of the stack. At least one spring device is usable to press the banding strip against the underside of the stack while it is sitting on the support plate. Movable actuations are used to compress the stack and to move a heatable die to a sealing location.

The advantages which can be obtained by the present invention consist, in particular, in that by use of the device, it is possible to rapidly and simply bundle bank notes, which are provided in the form of stacks containing a known number of bank notes. For this reason, the device is particularly suited for use in connection with a bank note printing and cutting machine, which machine delivers printed bank notes in the form of such stacks.

For wrapping such a stack with a banding strip, it is initially necessary to place the stack transversely over the banding strip. It is desirable to be able to do this by simply pushing the stack on a support. However, in the course of pushing the stack on a support, the problem arises that the stack has a tendency to push a previously placed banding strip aside. Pushing the banding strip under the stack is then not possible.

If an embedded channel for the banding strip is provided on the support plate, such as is known from U.S. Pat. No. 4,627,218, a banding strip, which is situated in the channel, cannot be displaced by a stack being pushed on top of it. It can be possible to push the banding strip through the channel after the stack has been placed on the support plate. However, the problem arises that at least the lowest bank notes get caught in the channel in the course of being pushed over the channel or become damaged.

These problems can be prevented by the provision of a tongue which can be displaced between an extended position, in which it separates the channel from the surface of the support plate and lets the stack be pushed over the channel, and a retracted position, in which the channel is open toward the surface of the support plate. A banding strip can be placed into the open channel and can be wrapped around the stack.

A spring element is preferably provided for pressing the banding strip against the underside of a stack which is resting on the support plate. This spring element can be displaced by the tongue in such a way that, in the extended position of the tongue, the spring leaves the channel open for the passage of the banding strip, so that the banding strip can be pushed into the channel without a noticeable resistance. The banding strip is only pressed against the underside of the stack in the retracted state of the tongue. The wrapping of the banding strip around the stack can take place. The spring is used to assure that the banding strip rests against the underside and the sides of the stack substantially without play.

To displace the spring element out of the channel in the extended state of the tongue, the tongue preferably has at least one elongated fin.

A first actuator is provided for pushing a stack into the chute. It preferably consists of a pressing element for pressing against the surface of the stack, so that the latter can be compressed prior to bundling. A central opening for the passage of a tool for connecting the ends of the banding strip is provided in the pressing element.

This tool can be a a heated die. The heated die can be pressed against. the ends of the banding strip for melting a heat-sealing adhesive applied to one end of the banding strip in order to connect the one end of the banding strip in this way with the opposite end of the banding strip.

A second actuator can be provided for pushing the bundled stack out of the chute. The second actuator is preferably usefully equipped with an arresting device for arresting the support plate at a predetermined depth of the chute. The arresting device makes it possible to exert a considerable pressure on the stack by operation of the first actuator and to compress the stack in this way to a preselected uniform height. Furthermore, a solid counterpressure is generated in the course of displacing the banding strip by the use of the heating die.

BRIEF DESCRIPTION OF THE DRAWINGS

Preferred embodiments of the present invention are represented in the drawings and will be described in what follows.

Shown are in.

DESCRIPTION OF THE PREFERRED EMBODIMENTS

Figure 1:
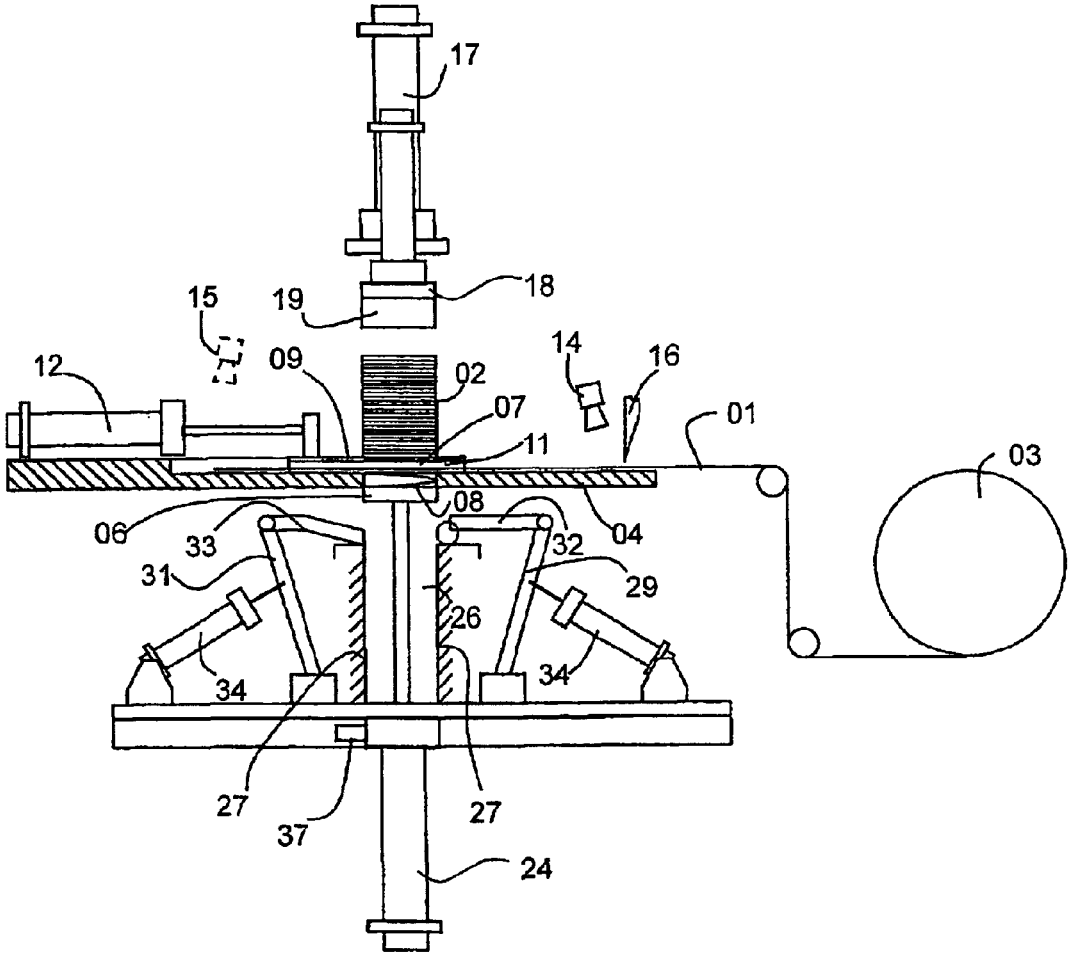
FIG. 1, a side elevation view, partly in cross-section through a device in accordance with the present invention taken parallel with the conveying direction of the banding strip in a first stage of the operating process of the device, in FIG. 2, a side elevation view, partly in cross-section through the device shown in FIG. 1 and taken in a conveying direction of the bank notes extending vertically in respect to the conveying direction of the banding strip, in FIG. 3, a side elevation view analogous to the one in FIG. 2 through the device in a second stage of its operating process, in FIG. 4, a side elevation view analogous to the one in FIG. 3 in a third stage of the operating process, in FIG. 5, a side elevation view analogous to the one in FIG. 1 in a fourth stage of the operating process, in FIG. 6, a side elevation view, again analogous to the one in FIG. 2 in a fifth stage, and in FIG. 7, a detail of a modification of the device.
Figure 2:
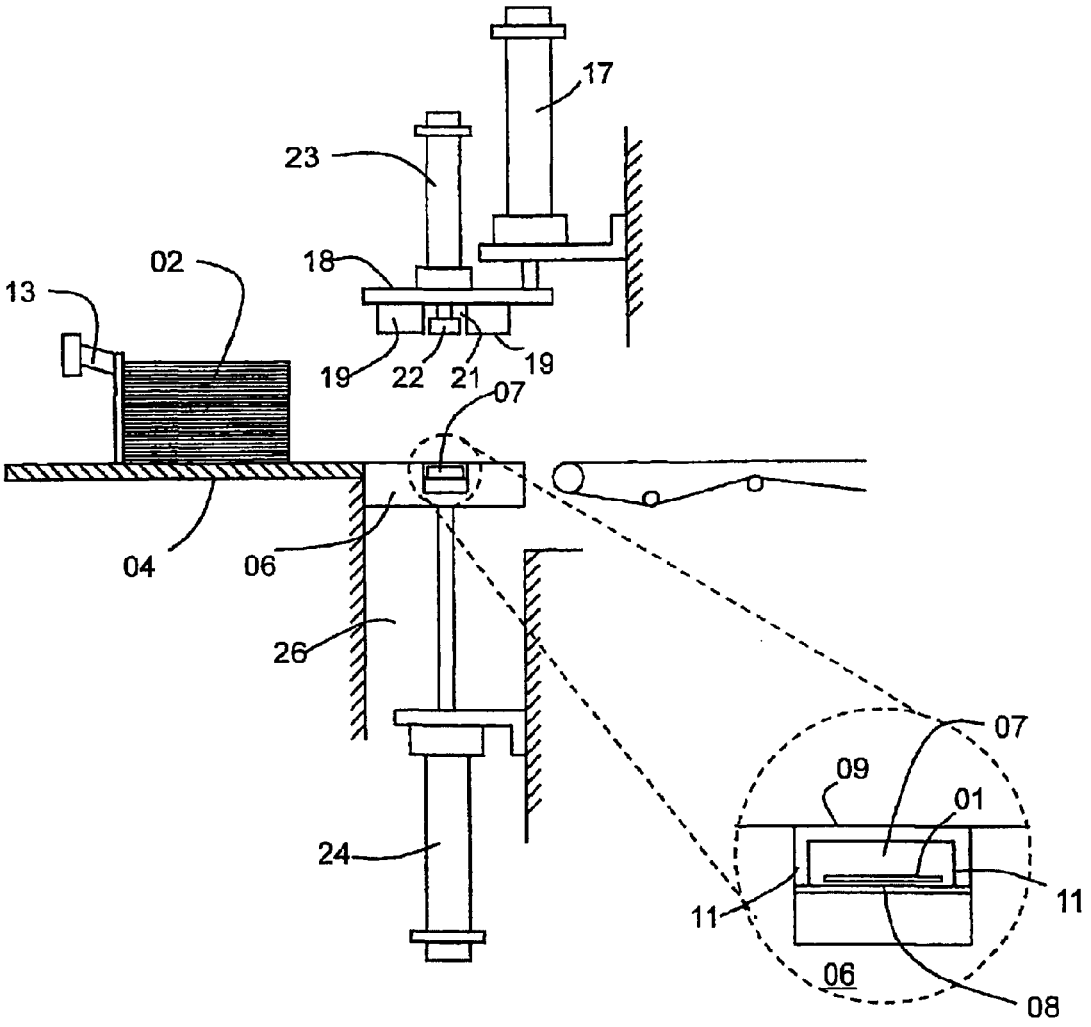

In FIGS. 1 and 2 the device for bundling a stack of sheet-type objects in accordance with the present invention is represented in a first stage of its operating process. These two drawings depict two steps in the method of the present invention and are taken along vertical planes extending perpendicularly in respect to each other.

FIG. 1 shows the device for banding a stack of sheet-type objects in a first side elevation view taken parallel with the conveying direction of a banding strip 01, which is intended to be used for bundling bank note stacks 02. The banding strip 01 is conveyed from a supply roll 03 onto a work table 04, into which a vertically movable support plate 06 has been integrated. For the sake of clarity, specific mechanisms for conveying the banding strip 01 are not represented in FIG. 1. As can be better seen in the side elevation view in FIG. 2, which view extends parallel to the conveying direction of the stack 02, a channel 07 runs in the conveying direction of the banding strip 01 and transversely across the support plate 06. A spring arrangement, in this case a leaf spring 08, is mounted on the bottom of the channel 07 and rises in the conveying direction of the banding strip 01, i.e. from the right to the left in FIG. 1. A rigid tongue 09, here in the form of a rectangular tube or of a C-profile, having two downwardly extending elongated fins 11, is displaceably arranged in the upper area of the channel 07. The displacement of the tongue 09 is controlled by a pneumatic cylinder 12.

In the operational phase of the embodiment of the invention represented in FIGS. 1 and 2, the tongue 09 extends over the width of the support plate 06 and past both sides of support plate 06 onto the work table 04. The fins 11 of tongue 09 keep the leaf spring 08 pushed down, so that the banding strip 01, coming from the supply roll 03, can be pushed through the channel 07 as far as the opposite side of the work table 04 and into its position represented in FIG. 1 without encountering resistance or running the danger of becoming stuck.

The banding strip 01 is provided with markers and with a partial adhesive application at regular intervals. The distance or spacing of the markers from each other along the strip 01 has been selected in accordance with the format of the bank notes to be provided with the banding strip and also in accordance with the number of bank notes which should be contained in a stack 02. A reading device 14 for the markers is arranged at a location which can be selected freely to the greatest extent along the path of the banding strip 01 from the supply roll 03 to the support plate 06 reading device 14 is used to monitor the conveying of the banding strip 01 and to stop the conveyance of the banding strip 01 after the length required for bundling a stack 02 has been pulled off supply roll 03. Depending on the type of markers, such as imprint, window, or the like, the reading device 14 can be designed as a camera, a photoelectric barrier or the like. As an alternative to the reading device 14, a sensor 15, which is indicated by dashed lines, and which is usable for detecting the leading end of the banding strip 01 and for stopping the conveying of the strip 01 when this end has been detected, could also be provided on the part of the conveyance path of the banding strip 01 that is located on the side of the support plate 06 opposite to the reading device 14. By displacing this sensor 15 along the conveying path, the length of the banding strip 01 to be conveyed for any of the stacks 02 to be bundled could be set.

A cutting device 16 is provided and is operated in response to the reading device 14, or the sensor 15, for cutting the banding strip 01 each time its intended length has been conveyed.

As can be seen by referring in particular to the partial enlargement shown in FIG. 2, as accented by a surrounding dashed circle, the top of the tongue 09 is flush with a top surface of the support plate 06 surrounding it. When the stack 02 is pushed by a stack pusher 13 from the position indicated in FIG. 2 onto the support plate 06, the lowermost bank notes in the stack 02 slide over the edges of the support plate 06 and the tongue 09 without being squashed or bent.

Figure 3:
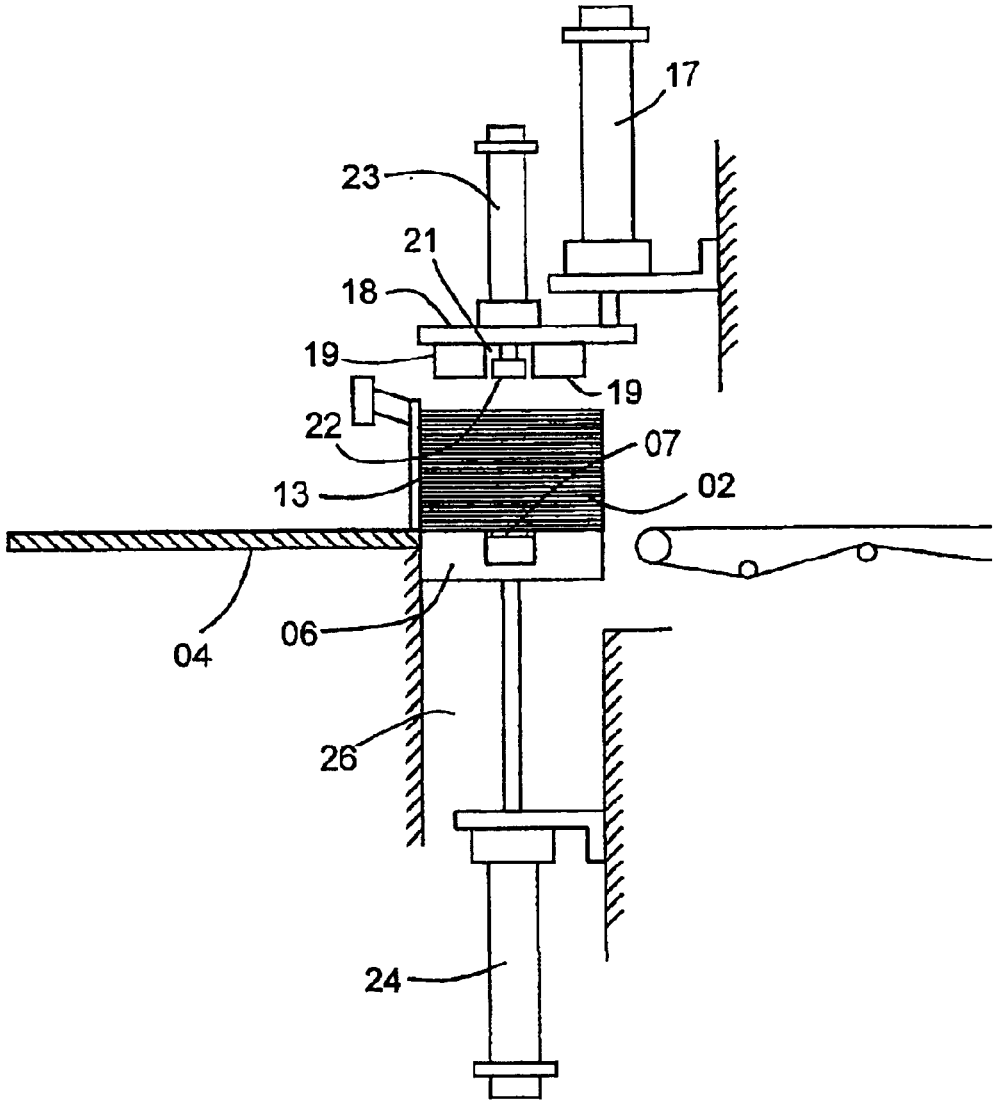

FIG. 3 shows a second stage of the operating cycle of the device for banding stacks of sheet-type objects in a view analogous to that of FIG. 2. By use of the stack pusher 13, the stack 02 of bank notes has been exactly positioned on the support plate 06, the dimensions of which support plate 06—at least in the direction of extension of the banding strip 01—correspond to those of the bank notes in the stack 02. The tongue 09 has now been retracted from its position represented in FIG. 1, in which it has entered the channel 07, so that it no longer touches the bank notes of the stack 02. This allows the leaf spring 08 to pivot upwards and to clamp the banding strip 01 against the underside of the stack 02.

A linearly displaceable upper or pressing actuator 17, in the form of a pneumatic cylinder, has been mounted above the support plate 06 and above the stack 02 lying on support plate 06. Upper actuator 17 supports a vertically movable pressing element 18. The pressing element 18 is comprised of two contact feet 19, which are intended to be pressed against the top of the stack 02 during the vertical movement of the first or pressing actuator 17. Pressing element 18 also includes a heatable die 22 situated in a gap 21 between the contact feet 19. With the aid of a third or die actuator 23, the heatable die 22 can be moved between a downward engaged position represented in FIG. 3, in which it is flush with the underside of the contact feet 19, and an upward retracted position, in which it substantially clears the gap 21.

The support plate 06 is also supported by its own actuator 24, here called a second or plate actuator 24, which makes possible a vertical movement of the support plate 06 between the position indicated in FIG. 3, in which the surface of the support plate 06 is flush with that of the work table 04, and a position wherein support plate is lowered into a chute 26 that is located underneath the work surface 04.

The lower or plate actuator 24 can also be provided as a pneumatic cylinder. If plate actuator 24 has a narrower piston cross section than the upper or pressing actuator 17, it is possible, by connecting the two actuators 17, 24 with an identical supply pressure, to clamp the stack 02 with a force proportional to the cross-sectional difference between the actuators 17 and 24 and simultaneously to push the stack 02, together with the support plate 06, into the chute 26.

Figure 4:
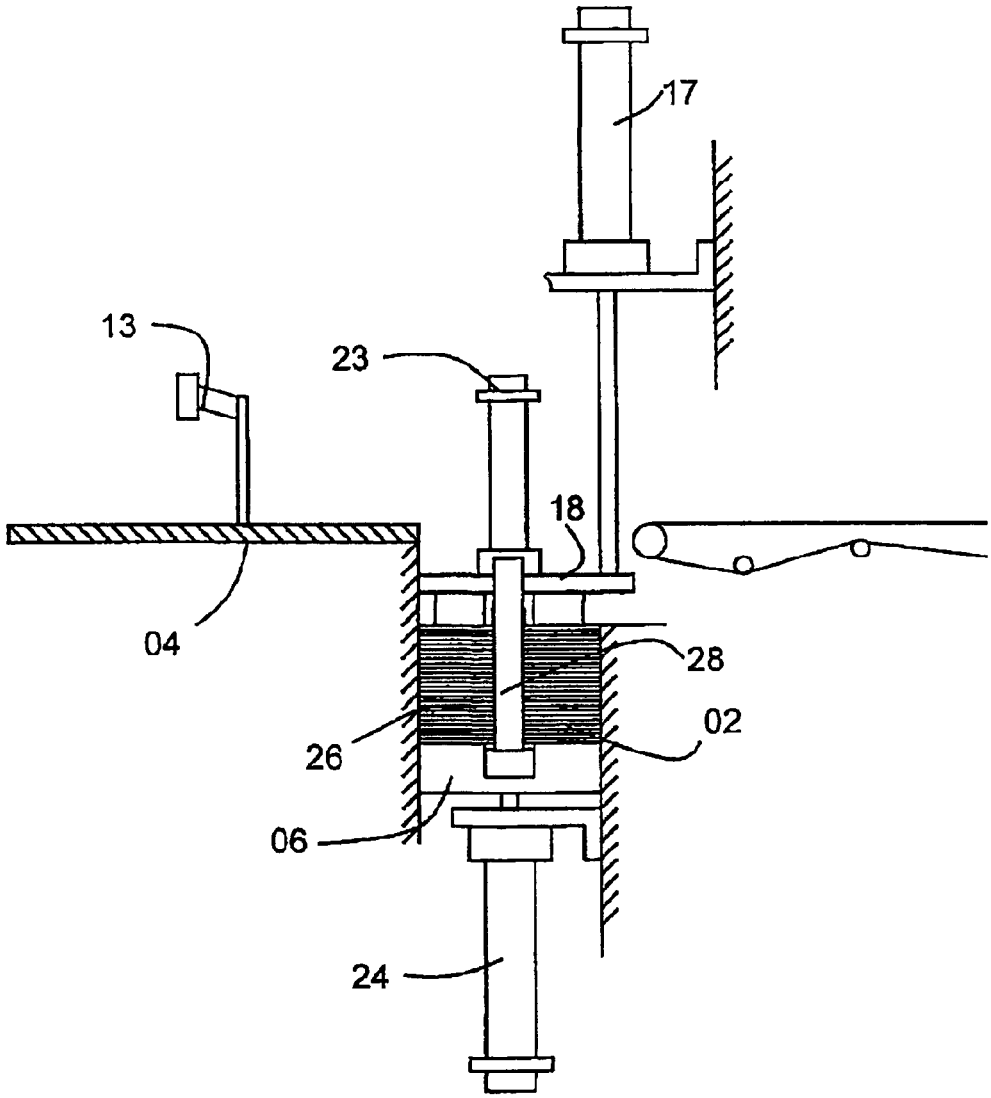

FIG. 4 shows the device for banding stacks of sheet-type objects in accordance with the present invention in a third-stage of its operating cycle. Here the pressing element 18 has been lowered and the stack 02, which is clamped between the pressing element 18 and the support plate 06, has been compressed to a predetermined thickness. By pushing the stack 02 into the chute 26, end sections 28 of the banding strip 01 projecting on both sides past the stack 02 are bent upward at the lateral walls 27, as seen in FIG. 1, of the chute 26 and project up past the top of the stack 02.

Figure 5:
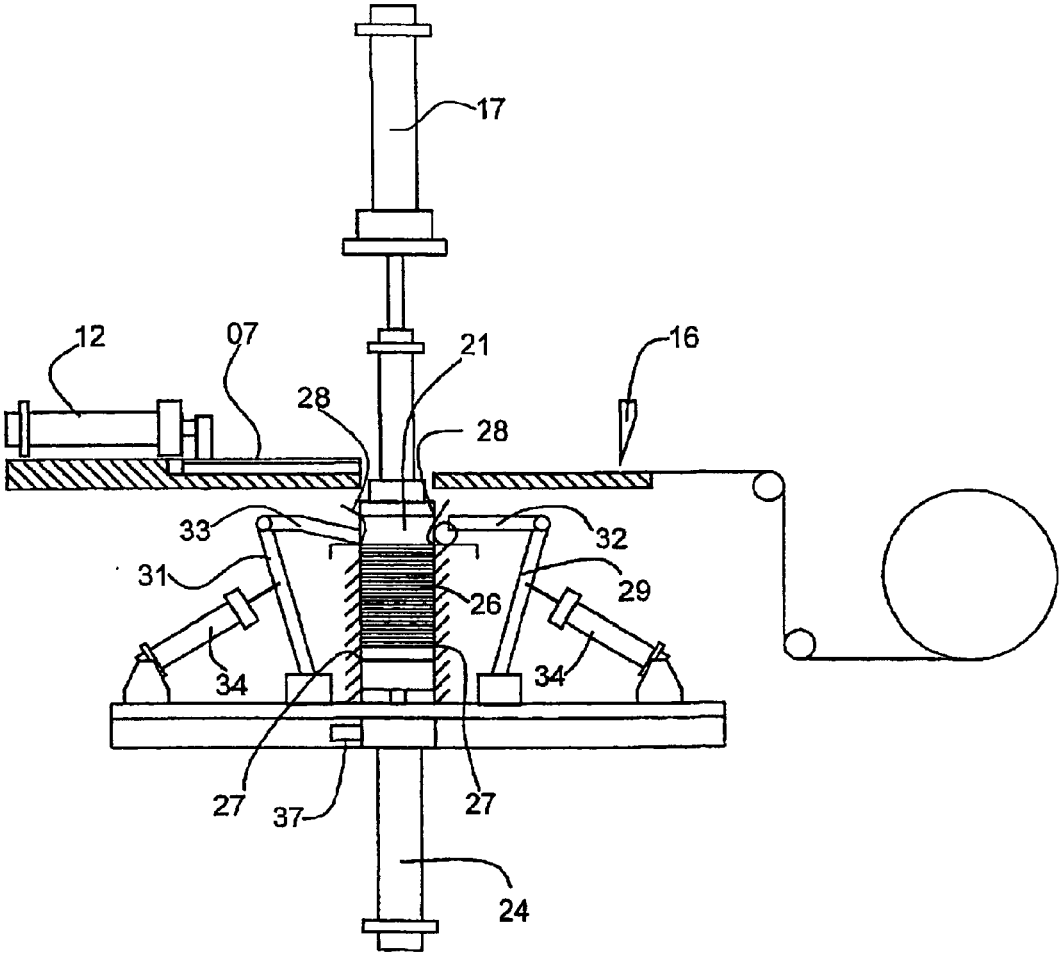

In this state at the latest, the heatable die 22 is lifted for clearing the gap 21, and two lateral pushers 29, 31, which are represented in FIG. 1 and in FIG. 5, become active one after the other. Each of the pushers 29, 31 has an arm 32, 33, which can be pushed into the gap 21, and a fourth or pusher actuator 34 for driving the movement of the arms. By pushing the arms 32, 33 one after the other into the gap 21, the upper ends of the two end sections 28 of a section of the banding strip 01 are bent over onto the top of the stack 02, so that they come to rest on top of each other. The partial adhesive application on the banding strip 01 has preferably been placed on the top of the first folded-over end section 28.

After the two arms 32, 33 have left the gap 21 again, the heatable die 22, which in FIG. 5 has been pulled upward out of the gap 21 and is therefore not visible, is lowered. Heatable die 22 is used for melting the adhesive application on banding strip 01 and to connect the two ends of the banding strip 01 in this way.

Figure 6:
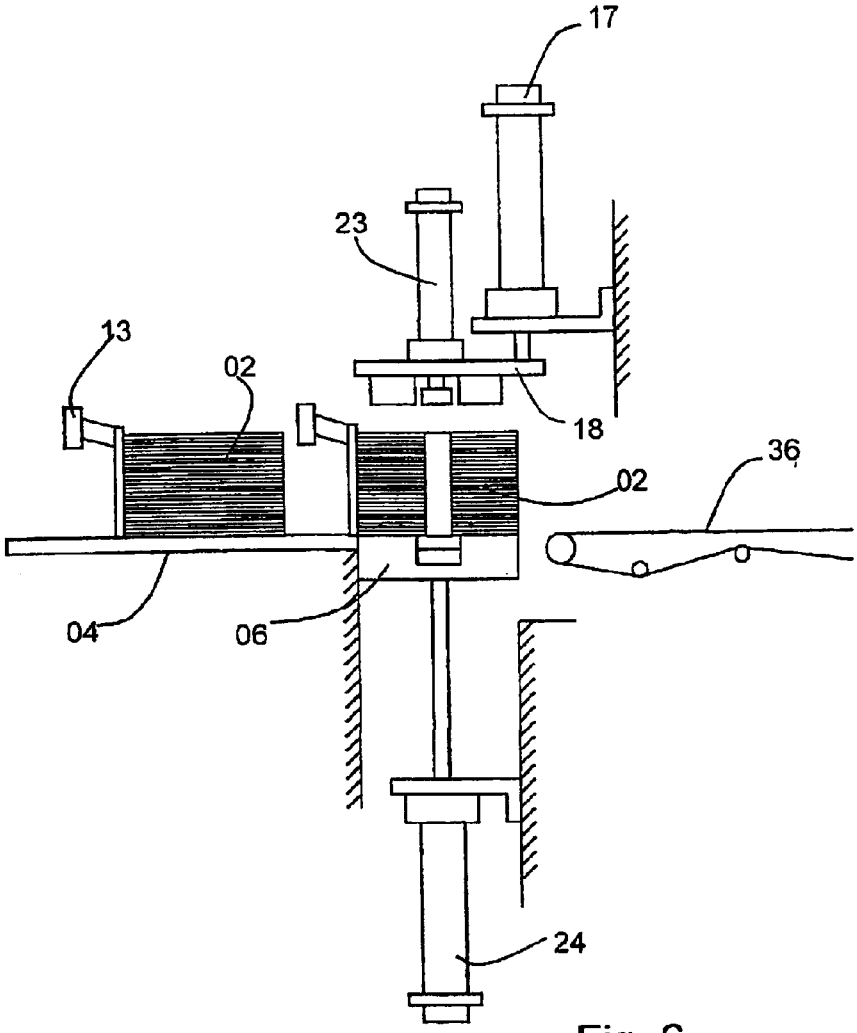

As shown in FIG. 6, the support plate 06 now returns to its raised position, in which it is flush with the work table 04. The pressing element 18 is simultaneously lifted to release the bundled stack 02. The now banded stack 02 is then pushed onto a conveyor belt 36 with the aid of a pusher 13, and a fresh stack 02 takes its place. Various modification of the device and its operating process are possible.

It is unimportant, for the functioning of the device, whether, at the start of processing a stack 02, the banding strip 01 is first inserted into the channel 07, or the stack 02 is first placed on the support plate 06.

As represented by use of the example of the arm 33 in FIG. 5, the arm 32, 33 pushed into the gap 21 can be a rigid body with a sharp edge, which edge interacts with the banding strip end section 28 for creating a sharp bend in the banding strip end section 28 or, as shown by way of the example of the arm 32, can have a roller or cylinder at its end. This roller or cylinder can be provided at the strip engaging end of the arms 32 or 33 in order to prevent any danger that the upper bank notes in the stack 02 may slip in the course of the insertion of the arms 32, 33 into the gap 21.

The lower or plate actuator 24 can be provided with an arresting device 37, which is usable to keep the support plate 06 immovably fixed in one or in a selected one of several positions, and in particular in the lowered position represented in FIGS. 4 and 5. A considerable pressure can possibly be exerted by the first actuator 17, which pressure is required to produce the desired thickness of the stack 02 and in this way to assure the unhampered introduction of the arms 32, 33 into the gap 21 and to thus insure a tight bundling of the bank notes.

Figure 7:
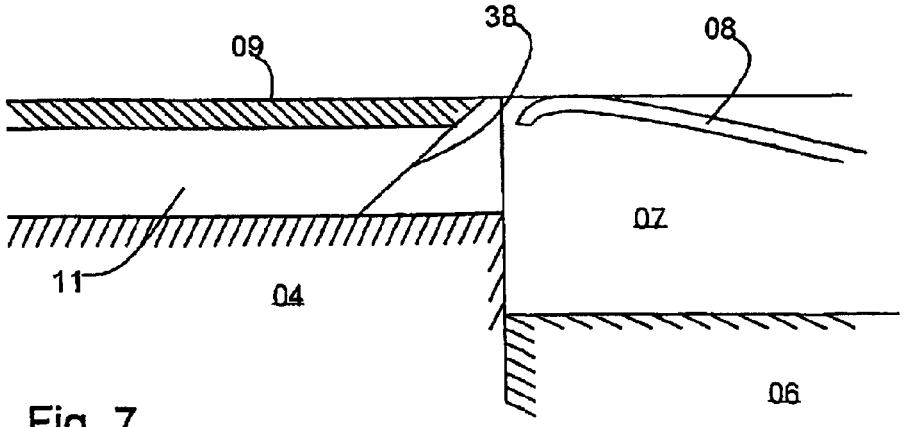

In connection with the embodiment of the device in accordance with the present invention, as represented in FIGS. 1 to 6, it has been assumed that the finished bundled stack 02 is put out on the same level of the work table 04 to which a stack 02 to be bundled is supplied. In order to make possible, with such a construction, the reintroduction of the tongue 09 into the channel 07 of the support plate 06 after the bundled stack 02 has been pushed out, it may be practical for a front or leading end 38 of the tongue 09 to be beveled, as shown in FIG. 7. When the tongue 09 is reinserted into the channel 07, it can displace the leaf spring 08 downward.

Alternatively, following the pushing-out of the stack 02, there is also the possibility of again lowering the support plate 06 sufficiently so that the tongue 09 can be brought into its extended position represented in FIG. 1, and to then lift the support plate 06, so that the leaf spring 08 is compressed by its contact with the underside of the fins 11.

A further option, which is not specifically represented in the drawings, consists in arranging the conveyor belt 36 on a level below that of the work table 04. In this arrangement, when the support plate 06 has reached the level of the work table 04, and after pushing out the stack 02, work table 04 is already empty and therefore the leaf spring 08 can be compressed by the tongue 09 which is already in the extended position.

The leaf spring 08 can be replaced by a helical spring with a cover plate, or with any other suitable type of spring element.

In place of the leaf spring 08, the support plate 06 can also have resilient elements next to the tongue 09 on its side facing the stack 02. In this way, the resilient elements constitute a channel for extending the tongue 09 and hold the stack 02. After the banding strip 01 has been inserted, the tongue 09 is retracted and the stack 02 is compressed by the support plate 06, so that the banding strip 01 is held by the stack 02.

While preferred embodiments of devices and a method for bundling a stack of sheet-like objects, in accordance with the present invention, have been set forth fully and completely hereinabove, it will be apparent to one of skill in the art that changes in for example the printing press used to form the sheet-like objects, the conveying assembly used to convey the bundled stacks and the like could be made without departing from the true spirit and scope of the present invention which is accordingly to be limited only by the following claims.

LIST OF REFERENCE NUMERALS

01 Banding strip
02 Stack
03 Supply roll
04 Work table
05 -
06 Support plate
07 Channel
08 Leaf spring
09 Tongue
10 -
11 Fin
12 Pneumatic cylinder
13 Pusher
14 Reading device
15 Sensor
16 Cutting device
17 Actuator, first, upper
18 Pressing element
19 Contact feet
20 -
21 Gap
22 Heatable die
23 Actuator, third
24 Actuator, second, lower
25 -
26 Chute
27 Lateral wall
28 End sections
29 Pusher
30 -
31 Pusher
32 Arm
33 Arm
34 Actuator, fourth
35 -
36 Conveyor belt
37 Arresting device
38 End, front

What is claimed is:

1. A device for bundling a stack of sheet material comprising:

the support plate for supporting a stack of sheet material for bundling;

a channel in said support plate, said channel being adapted to allow passage of a banding strip beneath a stack of sheet material on said support plate;

a stack receiving chute having spaced lateral boundary walls;

means for moving said support plate into said chute for folding a banding strip located beneath a stack on said support plate against lateral faces of a stack;

means for folding a banding strip passing beneath a stack and adjacent lateral faces of a stack against a top of a stack; and at least one spring element engageable with the banding strip passing beneath the stack of sheet material supported on said support plate to press the banding strip against an underside of the stack.

2. The device of claim 1 further including a tongue receivable in said channel.

3. The device of claim 2 wherein said tongue is a rectangular tube.

4. The device of claim 2 wherein said tongue includes an upper surface, said tongue upper surface being flush with said support plate when said tongue is in said channel.

5. The device of claim 2 wherein said tongue is shiftable between an extended position where it separates said channel from said support plate, and a retracted position in which said channel is open toward said support plate.

6. The device of claim 5 wherein said spring is displaceable by said tongue and wherein said spring is clear of said channel in said extended position of said tongue.

7. The device of claim 6 further including at least one elongated fin on said tongue, said elongated fin displacing said spring out of said channel.

8. The device of claim 1 wherein said spring element forms said channel.

9. The device of claim 8 wherein said spring element is movable and further wherein a banding strip can be fixed in place between a stack and said support plate.

10. The device of claim 1 further including a pressing actuator adapted to push a stack into said chute.

11. The device of claim 10 wherein said pressing actuator includes pressing elements to engage a top surface of a stack, said pressing elements defining a gap, and further including a strip end connecting tool, said tool being passable through said gap.

12. The device of claim 11 wherein said tool is a heatable die.

13. The device of claim 10 wherein said pressing actuator is a pneumatic cylinder.

14. The device of claim 1 further including a plate actuator to push a stack out of said chute.

15. The device of claim 14 further including a plate arresting device in said chute and engageable with said plate when said plate reaches a predetermined depth in said chute.

16. The device of claim 14 wherein said plate actuator is a pneumatic cylinder.

17. A method for bundling a stack of sheet material including:

providing a support plate;

forming a channel on said support plate;

supporting a stack of sheet material on said support plate;

providing a stack banding strip;

passing said stack banding strip through said channel and beneath said stack of sheet material on said plate;

providing a spring element beneath said stack of sheet material on said support plate; and pressing said banding strip against said stack using said spring element.

18. The method of claim 17 further including providing a stack receiving chute and moving said stack into said chute after placing said banding strip beneath said stack and further including using said chute for placing said banding strip against lateral faces of said stack.

19. The method of claim 17 further including providing a banding strip location sensor and detecting a position of said banding strip using said sensor prior to fixing said banding strip in place about a stack being banded.

20. The method of claim 17 further including providing said channel by changing a distance between said stack and said support plate.

21. The method of claim 17 further including providing at least one channel wall and using said channel wall for limiting movement of a leading end of said banding strip in a direction transverse to a banding strip conveying direction.

22. The method of claim 17 further including providing a tongue extendable into said channel.

23. The method of claim 22 including first introducing said tongue into said channel and then passing said banding strip into said channel.

24. A device for bundling a stack of sheet material comprising:

means for supporting a stack to be bundled;

means for encircling a banding strip about a stack to be bundled;

a first actuator usable to compress said stack while said banding strip is in place about said stack;

a heatable die; and a second actuator usable to move said heatable die into and out of contact with said banding strip, said second actuator being supported for movement by said first actuator.

* * * * *